US007169990B2

(12) United States Patent
Yoshisue

(10) Patent No.: US 7,169,990 B2
(45) Date of Patent: Jan. 30, 2007

(54) BACK CHECK FOR PIANO

(75) Inventor: Kenji Yoshisue, Shizuoka-ken (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 119 days.

(21) Appl. No.: 10/849,028

(22) Filed: May 20, 2004

(65) Prior Publication Data

US 2005/0005758 A1 Jan. 13, 2005

(30) Foreign Application Priority Data

Jul. 10, 2003 (JP) ..... 2003-194850

(51) Int. Cl.
*G10C 3/18* (2006.01)

(52) U.S. Cl. ..... 84/236

(58) Field of Classification Search ..... 84/216, 84/236, 239, 240, 241, 242
See application file for complete search history.

(56) References Cited

U.S. PATENT DOCUMENTS 2,502,107 A * 3/1950 Stein ..... 84/240
2,917,962 A * 12/1959 Ballet ..... 84/242

FOREIGN PATENT DOCUMENTS

JP 2003-36073 2/2003

* cited by examiner

*Primary Examiner*—Kimberly Lockett
(74) *Attorney, Agent, or Firm*—Crowell & Moring LLP

(57) ABSTRACT

A back check for a piano is provided for locking a returning hammer in a pivotal movement without fail and for saving the manufacturing cost. The back check is used for locking the hammer in a pivotal movement for returning after it has struck a string to prevent the hammer from rebounding. A back check, disposed at a location at which the hammer is locked, extends in a vertical direction, and has an adhering surface which rises in a central portion thereof in the vertical direction. An under felt is adhered on the adhering surface of the back check body. A sheet-like cushion material, which is adhered to the back check body to cover the under felt, is formed with a locking surface in a predetermined curved shape conformal to the adhering surface for locking the hammer.

2 Claims, 5 Drawing Sheets

PRIOR ART

BACK CHECK FOR PIANO

BACKGROUND OF THE INVENTION

1. Field of the Invention

The present invention relates to a back check for a piano which locks a hammer after it has struck a string to prevent the hammer from rebounding.

2. Description of the Prior Art

A conventional action having a back check is disclosed, for example, in Laid-open Japanese Patent Application No. 2003-36073. FIG. 1 illustrates an action 60 when a key 2 is released. The action 60, which may be for use with an acoustic grand piano, comprises a wippen 4 carried on a rear portion of the key 2 for pivotal movement about a rear end (left end in FIG. 1) thereof; a repetition lever 5 pivotably attached to the wippen 4; a jack 6; and a repetition spring 7 for urging the repetition lever 5 and jack 6 in a return direction (counter-clockwise direction in FIG. 1).

A key weight, not shown, is attached to a front portion of the key 2, such that a touch feeling is adjusted for the key 2 by balancing the key weight with the action 60 and the like. The repetition lever 5 is formed with a jack guide hole 5*c* extending vertically through a front portion thereof, and a hammer 3 is carried near the jack guide hole 5*c* through a shank roller 8.

The hammer 3 comprises a hammer shank 14 extending in a longitudinal direction and having a shank roller 8 attached thereto; a hammer head 15 attached at the leading end of the hammer shank 14; and the like. The hammer shank 14 has a proximal end pivotably attached to a hammer flange 16. The hammer head 15, which is made of a wood material, comprises a hammer wood 35 extending in the vertical direction; and a hammer felt 34 wound around a top portion of the hammer wood 35 for striking a string S extending above the hammer head 15.

The jack 6, which is pivotably attached to a fulcrum 4*b* in an upper end portion of the wippen 4, is generally formed in an L-shape, and has the upper end inserted in a jack guide hole 5*c* of the repetition lever 5 for movement along the jack guide hole 5*c*. A jack button screw 11 is screwed through the jack 6 in the longitudinal direction in such a manner that the jack button screw 11 can be moved front and rear in order to adjust the angular position of the jack 6.

A jack button 12 is formed integrally with the leading end of the jack button screw 11. The jack button 12 is attached to the jack 6 with the jack button screw 11 being screwed into one end surface thereof at the center. The jack button 12 has the other end surface in contact with a spoon 13 of the wippen 4.

On the top surface of a rear end portion of the key 2, a back check 40 is attached through a seat plate 2*a* and a back check wire 41 with a slight spacing defined between the back check 40 and a tail 35*a* of the hammer wood 35. The back check 40 comprises a back check body 42; and a cushion material 43 adhered from the front surface to an upper portion of the back surface of the back check body 42.

As the key 2 is depressed from the key released state, the wippen 4 is pushed up to make a pivotal movement, causing the repetition lever 5 and jack 6 to move up together with the wippen 4. Associated with these movements, the repetition lever 5 first slides the shank roller 8 and simultaneously pushes up the hammer 3 through the shank roller 8, causing the hammer 3 to make a pivotal movement. Next, the repetition lever 5 is brought into engagement with the drop screw 9, causing the upper end of the jack 6 to push up the hammer 3 through the shank roller 8. Subsequently, at the time the hammer 3 has pivotally moved until immediately before it strikes the string S stretched above, the front end of the jack 6 is brought into engagement with the regulating button 10 to make a pivotal movement, and moves away from the shank roller 8. Consequently, the hammer 3 is released from the coupling with the action 60 and key 2, and strikes the string S in a freely pivotable way.

The hammer 3, which has struck the string S, pivotally moves in the return direction by a reaction of striking the string S. In this event, the key 2 remaining depressed causes the back check 40 in the rear end portion of the key 2 to be positioned at a level higher than when the key 2 is in the key released state. The tail 35*a* of the hammer 3 in the pivotal movement for returning collides with the back check 40 in the foregoing state. Since the cushion material 43 is adhered on the back check 40, the hammer 3, which has come into contact with the back check 40, is locked and stopped at that position without making a rebound.

Subsequently, at a timing at which the key 2 is released and returned to some extent, the repetition lever 5 begins to initiate its action, wherein the repetition lever 5 pivotally moves with a spring force of the repetition spring 7 to return in the counter-clockwise direction, thereby sliding and simultaneously pushing up the shank roller 8. This permits the jack 6 to pivotally move with the spring force of the repetition spring 7 to return in the counter-clockwise direction, and the jack button 12 to come into contact with the stopper 13, thereby returning to an original angular position. In this way, at the time the jack 6 returns to the original angular position, the hammer 3 had already been stopped as mentioned above, so that the hammer 3 can strike the string S the next time even if the key 2 has not been completely returned, thus permitting the hammer 3 to successively strike the same string S. In this way, the same key 2 can be rapidly beaten in succession as is the case with playing trill.

On the other hand, a back check structured in the following manner is also known in the past. As illustrated in FIG. 2, a back check 50 comprises a back check body 51; an under felt 52; and a leather 53 having cushioning properties. The back check body 51 is formed with a flatly cut felt adhering surface 51*a* in an upper half of a front surface of the back check body 51. The under felt 52 is adhered to the felt adhering surface 51*a*. The under felt 52 is shaved with a sandpaper or the like after the adhesion for shaping such that its upper portion is thicker than its lower end portion. The leather 53 in turn is adhered from the lower end of the front surface to an upper portion of the back surface of the back check 50 to cover the under felt 52. Thus, the surface of the leather 53 on the front side presents a smooth curve, with a slight recess substantially at the center in the vertical direction in conformity to the shape of the under felt 52. Thud, during a pivotal movement of the hammer 3 associated with key depression from the key released state, the tail 35*a* of the hammer 3 pivotally moves along the curved surface of the leather 53 to avoid a contact with the back check 50 without fail. Also, immediately after the hammer 3 has struck the string S, the tail 35*a* of the hammer 3 which makes a pivotal movement for returning by the reaction of striking the string S is locked by the small recess in the leather 53 to more effectively mitigate a shock when the hammer 3 collides with the back check 50, thereby making it possible to stop the hammer 3 with more certainty.

However, the conventional back check for a piano described above has the following problems. Specifically, for providing the leather 53 with the curved surface, the under felt 52 must be shaped with a sandpaper or the like after it has been adhered to the back check body 51, causing a corresponding increase in the manufacturing cost.

The back check is attached to a rear end portion of the key 2 at a position away from the fulcrum of the key 2 in a grand piano, whereas the back check is attached at a position away from the center of the pivotal movement of the wippen in an upright piano. Thus, in either type of piano, the weight of the back check relatively significantly affects a static load which determines a touch feeling of the key 2, so that a certain amount of key weight must be attached to a front portion of the key 2 in order to ensure a proper static load. As such, the amount of the key weight cannot be reduced, leading to a failure in saving the manufacturing cost.

SUMMARY OF THE INVENTION

The present invention has been made to solve the problems as mentioned above, and it is an object of the invention to provide a back check for a piano which is capable of locking a returning hammer in a pivotal movement without fail and which contributes to a reduction in the manufacturing cost.

To achieve the above object, the present invention provides a back check for use in a piano for locking a hammer in a pivotal movement for returning after the hammer has struck a string to prevent the hammer from rebounding. The back check is characterized by comprising a back check body disposed at a location at which the hammer is locked, extending in a vertical direction, and having an adhering surface which rises in a central portion thereof in the vertical direction; an under felt adhered on the adhering surface of the back check body; and a sheet-like cushion material adhered to the back check body to cover the under felt, the cushion material being formed with a locking surface in a predetermined curved shape conformal to the adhering surface for locking the hammer.

According to this back check for a piano, the adhering surface on the back check body rises in the central portion in the vertical direction, so that the under felt adhered on the adhering surface also rises in its central portion in conformity to the shape of the adhering surface. Thus, the cushion material adhered to the back check body to cover the under felt has a curved surface. In other words, the cushion material can be provided with a curved surface only by adhering the under felt and cushion material in order, and therefore no need exists for shaping the under felt after it has been adhered to the back check body, thereby saving the cost required for the manufacturing by the elimination of the shaping.

Preferably, in the back check for a piano described above, the back check body may include at least one of a hole or a recess formed therein for reducing a weight thereof.

According to this preferred embodiment of the back check for a piano, since the back check body is formed with at least one of a hole and a recess, the back check is correspondingly reduced in weight. Thus, in either a grand piano or an upright piano, the amount of key weight for achieving a proper static load can be reduced to save the manufacturing cost by the reduced key weight.

DETAILED DESCRIPTION OF THE PREFERRED EMBODIMENTS

Figure 1:
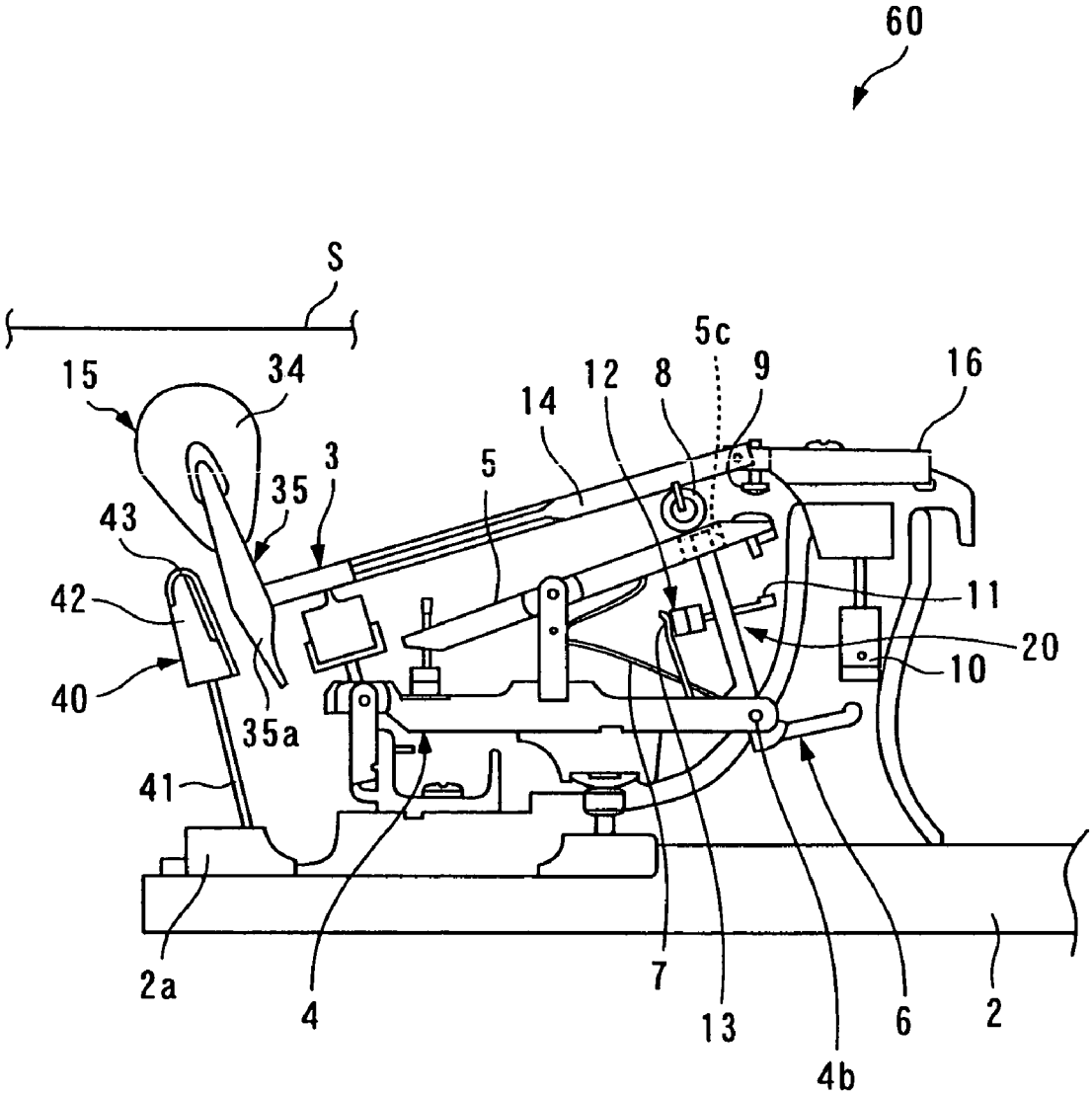
FIG. 1 is a lateral view of a conventional action including a back check in a grand piano.
Figure 2:
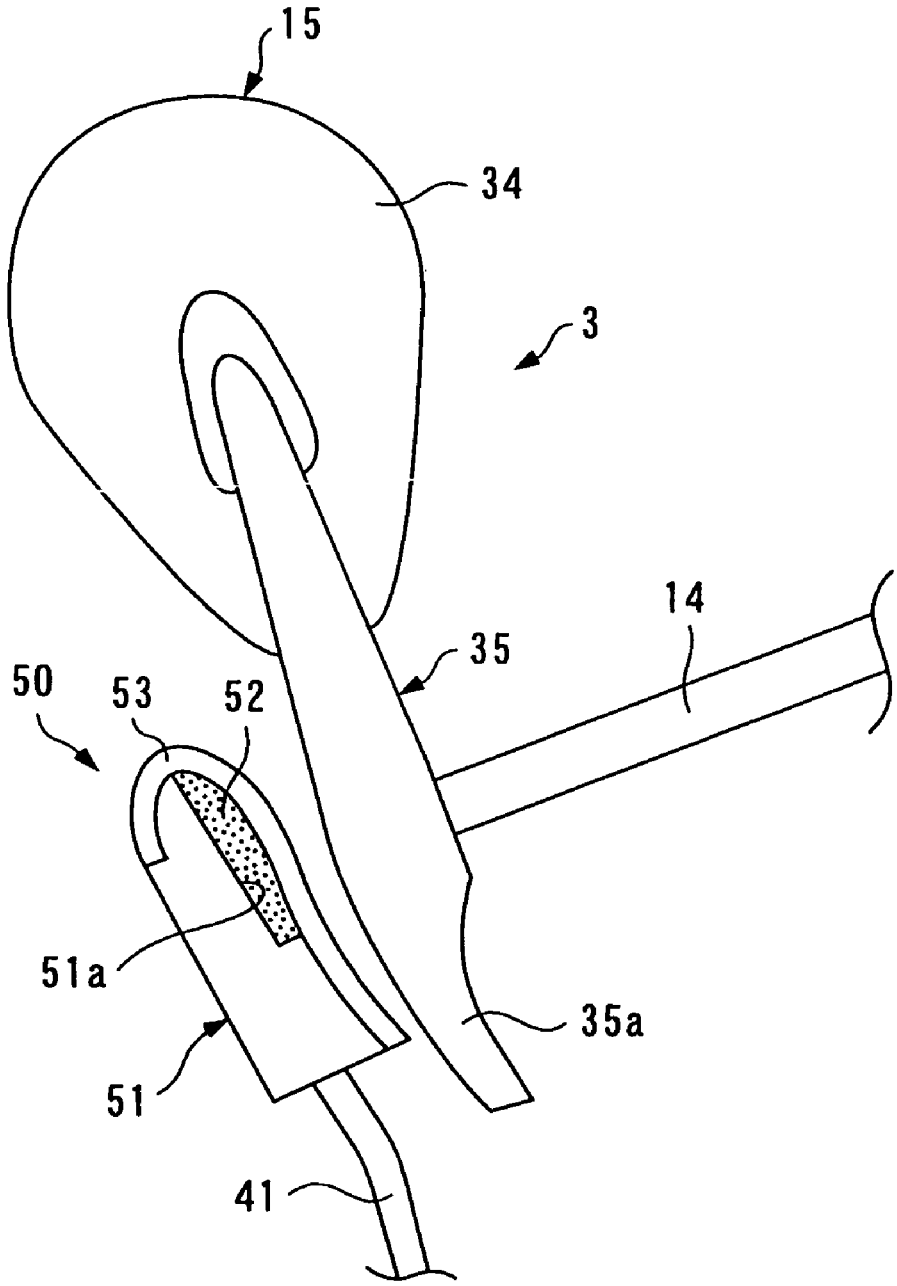
FIG. 2 is an enlarged view of another example of conventional back check near a hammer head.
Figure 3:
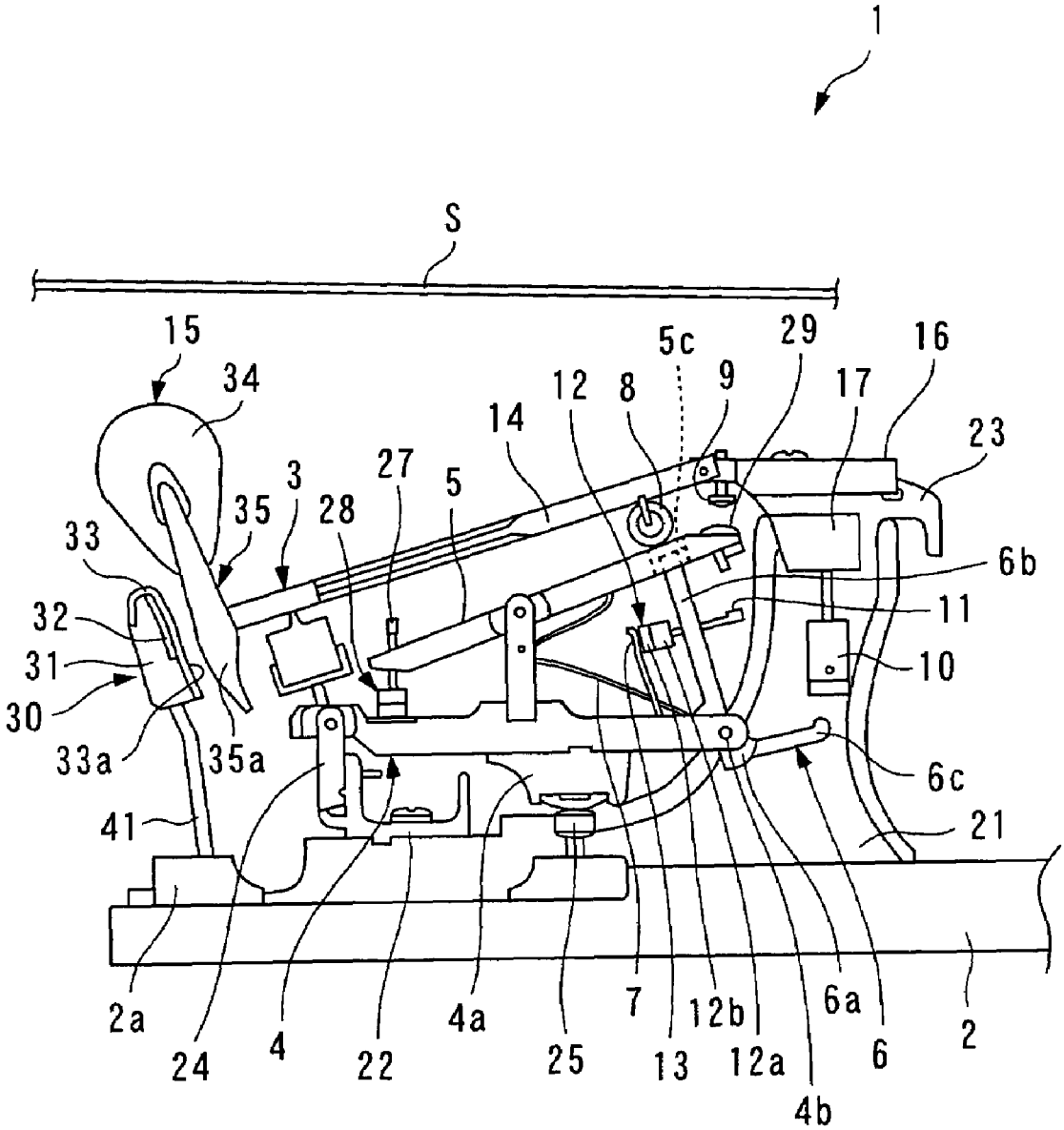
FIG. 3 is a lateral view of an action including a back check, to which the present invention is applied, in a grand piano.

In the following, a preferred embodiment of the present invention will be described in detail with reference to the accompanying drawings. FIG. 3 illustrates an action 1 for an acoustic grand piano that includes a back check 30 to which the present invention is applied. The illustrated action 1 is identical in the basic structure to the conventional action 60 previously described, and differs only in details of the structure in the back check 30 and the like, so that common components are designated the same reference numerals in the following description.

The action 1 is attached between a left and a right bracket 21 (only one of which is shown). The left and right brackets 21 are fixed to a key frame (not shown) which carries keys 2. A wippen rail 22 and a hammer shank rail 23 are extended between the left and right brackets 21, and the rear end of a wippen 4 is pivotably attached to each wippen flange 24 screwed on the wippen rail 22.

Each wippen 4, which is formed of a wood material or a synthetic resin in a predetermined shape, rests on a capstan button 25, disposed in a rear portion on the top surface of the corresponding key 2, through a heel 4*a*. A repetition lever 5 is pivotably coupled to the wippen 4 in a central portion thereof, and is in sliding contact with a shank roller 8 of the hammer 3 in a front portion of the top surface.

The repetition lever 5, made of a wood material or a molding of a synthetic resin, is rectangular in cross-section, and extends obliquely upward from rear to front in the longitudinal direction. A jack guide hole 5*a* is formed vertically through the repetition lever 4 at a predetermined position in a front region of the repetition lever 4, and a lever skin 29 is adhered on the top surface of the repetition lever 5 in front of the jack guide hole 5*c*. A lever screw 27 is screwed vertically through a rear end portion of the repetition lever 5 in such a manner that the lever screw 27 can move up and down. A lever button 28 is formed integrally with the lever screw 27 at the lower end thereof. The repetition lever 5 is also urged by a repetition spring 7 attached to the wippen 4 in a return direction (counter-clockwise direction in FIG. 3).

A jack 6 is made up of a proximal portion 6*a* pivotably attached to a fulcrum 4*b* of the wippen 4; a hammer actuator 6*b* which extends in the vertical direction from the proximal portion 6*a*; and a regulating button contact 6*b* which extends in front (to the right in FIG. 3) from the proximal portion 6*a*. The jack 6 is integrally formed, for example, by a molding made of a synthetic resin. The leading end of the hammer actuator 6*b* is inserted into the jack guide hole 5*c* of the repetition lever 5 for movements in the longitudinal direction, and opposes the shank roller 8 with a slight spacing from the shank roller 8 in a key released state. The jack 6 is also urged in the return direction (counter-clockwise direction in FIG. 3) by the repetition spring 7 for urging the repetition lever 5.

A jack button screw 11 is screwed through substantially at the center of the hammer actuator 6*b* in the longitudinal direction in such a manner that the jack button screw 11 can move front and back. A jack button 12 is disposed integrally with the leading end of the jack button screw 11 for adjusting the angular position of the jack 6. The jack button 12 comprises a jack button body 12*a* screwed into the jack button screw 11 for attachment; and a felt 12*b* adhered on the end surface opposite to the jack button screw 11. The felt 12*b* is in abutment to a stopper 13 implanted on the wippen 4 in a key released state.

The hammer 3 comprises a hammer shank 14 extending in the longitudinal direction, a hammer head 15 attached to the leading end of the hammer shank 14, and the like. The hammer 3 is pivotably attached to a hammer shank flange 16 screwed to a hammer shank rail 23. The shank roller 8 is attached at a predetermined position in a front portion on the bottom surface of the hammer shank 14. The shank roller 8 is formed in a cylindrical shape, for example, with inner cloth and a skin wound over the cloth, and opposes the front end of the repetition lever 5 with a predetermined spacing therebetween.

A regulating rail 17 is fixed by screws on the bottom surface of the hammer shank rail 23. A regulating button 10 is screwed into the bottom surface of the regulating rail 17 in such a manner that the regulating button 10 can move up and down for limiting upward pivotal movements of the jack 6. The regulating button 10 opposes the leading end of the regulating button contact 6*c* of the jack 6 with a predetermined spacing defined therebetween.

The hammer head 15 comprises a hammer wood 35 attached to the leading end the hammer shank 14; and an under felt 34 wound around a top portion of the hammer wood 35 for striking a string S extending above the hammer head 15. The hammer wood 35 extends in the vertical direction to form substantially a right angle to the hammer shank 14. A portion of the hammer wood 35 above a connection with the hammer shank 14 is substantially symmetrically tapered in the upward direction. A portion of the hammer wood 35 below the connection with the hammer shank 14 is tapered in the downward direction to form a curved tail 35*a* which has a rear surface that is made convex toward the outside, and a front surface that is made slightly convex toward the inside.

Figure 4A:
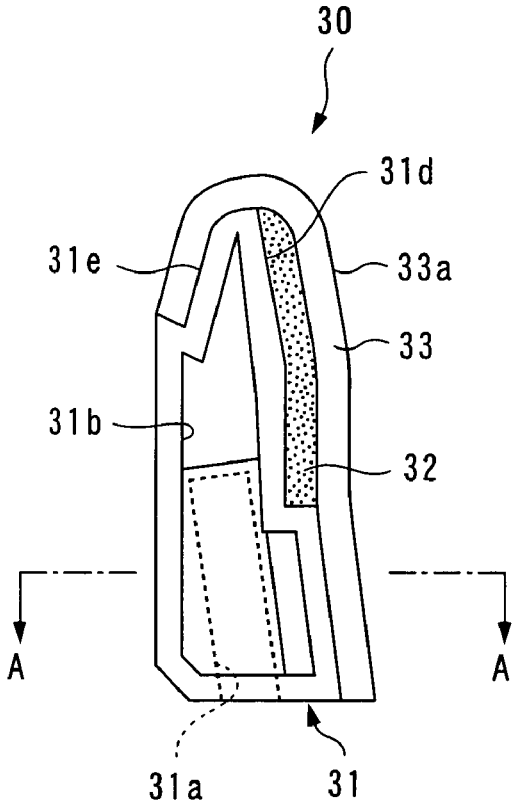
FIGS. 4A and 4B are lateral views illustrating the back check in FIG. 3 when it is assembled and when it is disassembled, respectively.
Figure 4B:
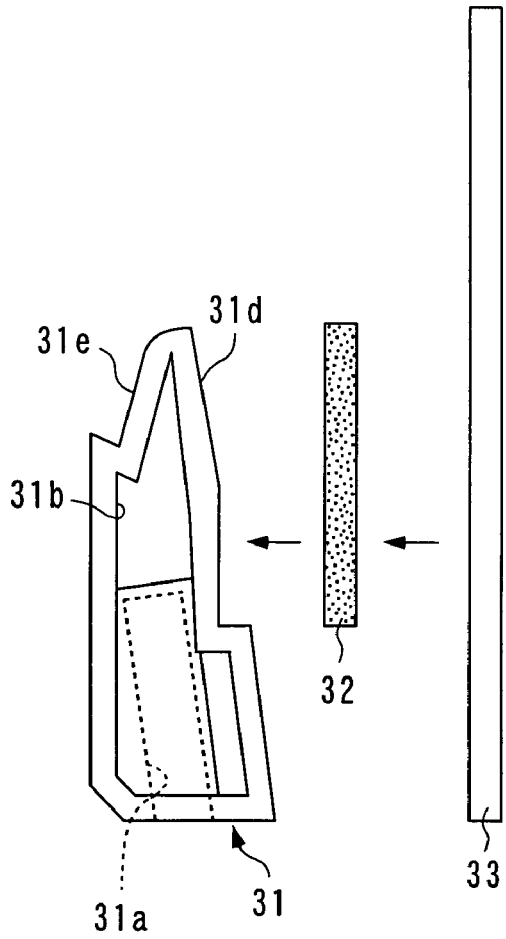

Behind the tail 35*a*, the back check 30 opposes the tail 35*a* with a slight spacing therebetween. The back check 30 is attached to the top surface of a rear end portion of the key 2 through a seat plate 2*a* and a back check wire 41. As illustrated in FIGS. 4A, 4B, the back check 30 is made up of a back check body 31; and an under felt 32 and a sheet cushion material 33 adhered to the back check body 31 in order. The back check body 31, which is made, for example, of a wood material or a synthetic resin, has a predetermined shape elongated in the vertical direction. The back check body 31 is formed with a attachment hole 31*a* of a predetermined depth in the bottom surface thereof, such that the back check wire 41 is inserted into the attachment hole 31*a* to attach the back check 30 to the key 2.

Figure 5:
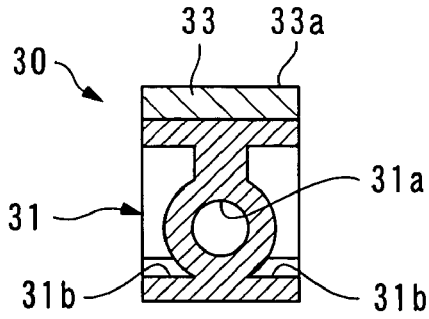
FIG. 5 is a cross-sectional view taken along a line A—A in FIG. 4A.

Weight reducing recesses 31*b* are formed symmetrically to each other on both left and right sides of the back check body 31 over substantially the entire surfaces except for the outer peripheries. As illustrated in FIG. 5, each weight reducing recess 31*b* has a portion corresponding to the attachment hole 31*a* which is shallow enough to avoid the attaching hole 31*a*, and the remainder which has a constant depth larger than that of the shallow portion. Also, a portion extending from an upper half of the front surface to a top portion of the back surface of the back check body 31 is cut away in a predetermined depth along these surfaces, and the front surface of the cut portion serves as a felt adhering surface 31*d*, while the back surface of the cut portion serves as a cushion material adhering surface 31*e*. The felt adhering surface 31*d* slightly rises in a central portion in the vertical direction.

As illustrated in FIG. 4A, the under felt 32 of a predetermined thickness is adhered to the felt adhering surface 31*d*, such that the surface of the under felt 32 is flash with the lower portion of the front surface of the back check body 31. As mentioned above, since the felt adhering surface 31*d* slightly rises in the central portion in the vertical direction, the under felt 32, which is adhered to the felt adhering surface 31*d*, slightly rises in a similar manner, in conformity to the shape of the felt adhering surface 31*d*.

Figure 6:
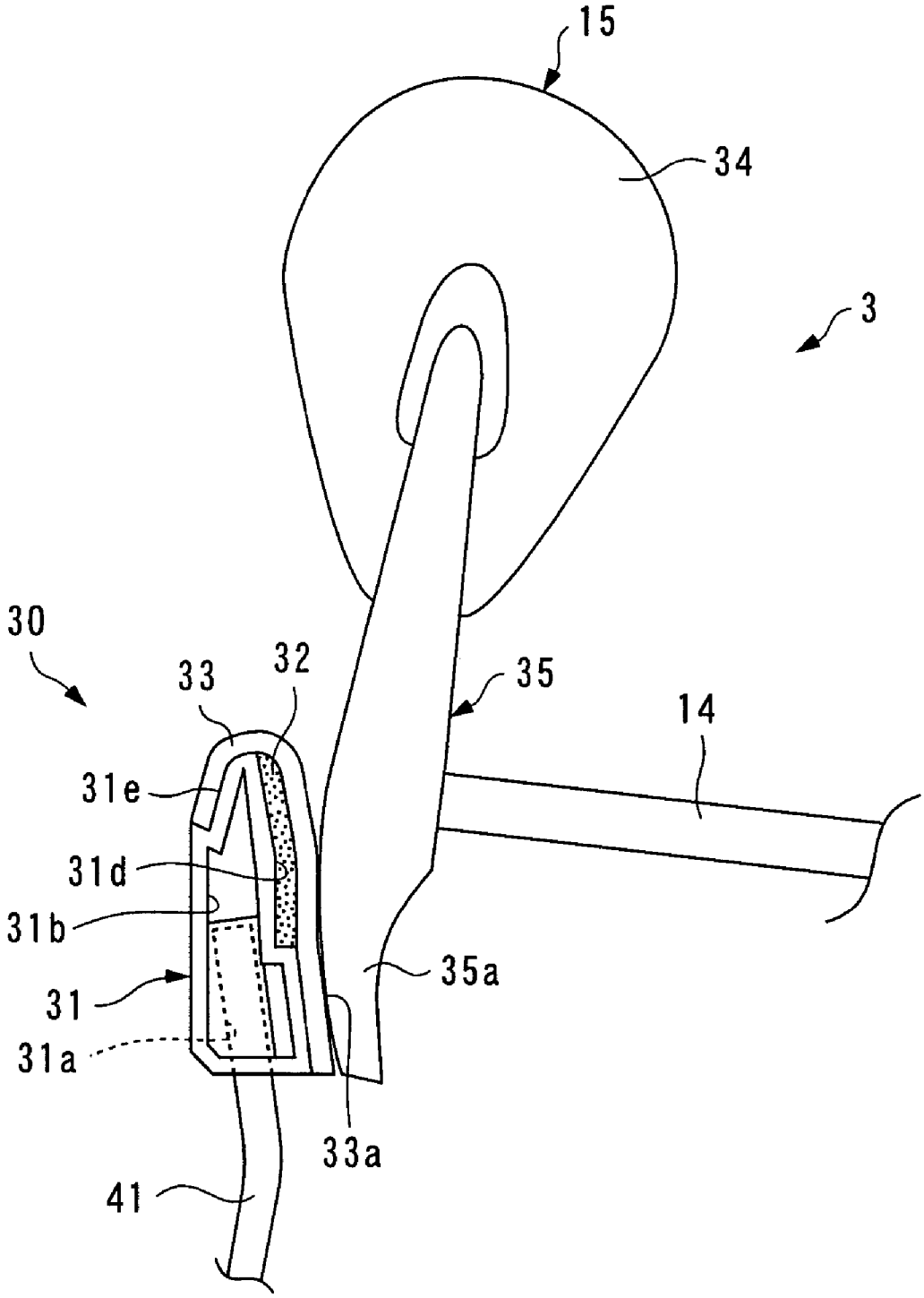
FIG. 6 is a lateral view illustrating a hammer locked by the back check.

The cushion material 33 in turn is made, for example, of deerskin or artificial leather, is adhered from the lower end of the front surface of the back check body 31 along the front surface and the surface of the under felt 32, and further over the cushion material adhering surface 31*e* on the back surface, thereby covering the under felt 32 from the front. Also, since the felt 32 rises in the central portion in the vertical direction as mentioned above, the cushion material 33 adhered on the surface of the felt 32 also has a shape conformal to the felt 32. As a result, the cushion material 33 has a front surface having a slightly rising portion corresponding to the central portion of the felt adhering surface 31*d*, and a slight recess near the boundary between the felt 32 and the back check body 31 below the slight rise. Eventually, the front surface of the cushion material 33 serves as a curved locking surface 33*a* which substantially slowly curves as a whole. With the locking surface 33*a* having such a curved shape, when the hammer 3 pivotally moves in response to depression on the key 2 in the key released state as illustrated in FIG. 6, the tail 35*a* of the hammer 33 pivotally moves along the locking surface 33*a*, thereby making it possible to prevent the hammer 3 from coming into contact with the back check 30 without fail. Also, when the hammer 3 makes a pivotal movement for returning after it has struck the string S, the tail 35*a* of the hammer 3 is locked by the recess of the locking surface 33*a*, thus effectively buffering the impact generated by a collision with the back check 30, and stopping the hammer 3 without fail to prevent the hammer 3 from rebounding.

Since the operation of the action 1 in the foregoing structure is basically the same as the operation of the conventional action 50 described above, description thereon is omitted.

According to the action 1 in the foregoing structure, the felt adhering surface 31*d* of the back check body 31 is formed such that its central portion in the vertical direction rises, so that the locking surface 33*a* of the back check 30 can be made in a predetermined curved shape in conformity to the shape of the felt adhering surface 31*d* only by adhering the under felt 32 and cushion material 33 in order through the felt adhering surface 31*d* having the shape as mentioned above. Consequently, since there is no need for shaping the under felt 32 after it has been adhered to the back check body 31, the cost required for the manufacturing can be saved by the elimination of the shaping.

Also, since the back check body 31 is formed with the left and right weight reducing recesses 31*b* symmetric to each other, the back check 30 is reduced in weight by the weight reducing recesses 31*b*. It is therefore possible to reduce the amount of the key weight for achieving a proper static load and further save the manufacturing cost correspondingly.

It should be understood that the present invention is not limited to the foregoing embodiment, but may be practiced in various manners. For example, while the back check body 31 is provided with the left and right symmetric weight educing recesses 31*b*, the present invention is not limited to such a back check body, but the weight reducing recesses 31*b* can be freely set in terms of the number and shape as long as they do not interfere with the attachment hole 31*a* and they do not damage the strength of the back check body 31. Alternatively, the weight reducing recesses 31*b* may be replaced with a hole extending through the back check body 31 provided that the same conditions are satisfied.

Also, while the foregoing embodiment has been described in connection with an example in which the present invention is applied to the back check for an acoustic grand piano, the present invention is not limited to such a back check, but can be applied to a general back check for any piano having the action mechanism such as an upright piano, an electronic piano, and the like. Otherwise, the present invention can be modified in detailed structure as required without departing from the spirit and scope of the invention as defined by the appended claims.

As described above, the back check for a piano according to the present invention can advantageously lock a returning hammer in a pivotal movement without fail and contribute to a reduction in the manufacturing cost.

What is claimed is:

1. A back check for use in a piano for locking a hammer in a pivotal movement for returning after said hammer has struck a string to prevent said hammer from rebounding, said back check comprising:

a back check body disposed at a location at which said hammer is locked, extending in a vertical direction, and having an adhering surface which rises in a central portion thereof in the vertical direction;

an under felt adhered on said adhering surface of said back check body; and a sheet-like cushion material adhered to said back check body to cover said under felt, said cushion material being formed with a locking surface in a predetermined curved shape conformal to said adhering surface for locking said hammer.

2. A back check for a piano according to claim 1, wherein said back check body comprises at least one of a hole or a recess formed therein for reducing the weight thereof.

* * * * *